US007468680B2

(12) United States Patent
Heffernan

(10) Patent No.: US 7,468,680 B2
(45) Date of Patent: Dec. 23, 2008

(54) TRAFFIC LIGHT SAFETY ZONE

(76) Inventor: John Heffernan, 2 Gables Blvd., East Setauket, NY (US) 11733

( * ) Notice: Subject to any disclaimer, the term of this patent is extended or adjusted under 35 U.S.C. 154(b) by 197 days.

(21) Appl. No.: 11/473,985

(22) Filed: Jun. 24, 2006

(65) Prior Publication Data

US 2007/0296610 A1 Dec. 27, 2007

(51) Int. Cl.
*G08G 1/096* (2006.01)

(52) U.S. Cl. ..... 340/932; 340/916; 340/929; 404/16

(58) Field of Classification Search ..... 340/916, 340/929, 932; 404/16
See application file for complete search history.

(56) References Cited

U.S. PATENT DOCUMENTS 4,770,495 A * 9/1988 Lees ..... 359/534
4,847,618 A * 7/1989 Baustin ..... 340/929
4,908,616 A * 3/1990 Walker ..... 340/929
5,457,439 A 10/1995 Kuhn
6,388,578 B1 * 5/2002 Fagan et al. ..... 340/901
7,187,301 B2 * 3/2007 Lu ..... 340/929
2002/0201497 10/2004 Naljotov

* cited by examiner

*Primary Examiner*—George A Bugg
*Assistant Examiner*—Hoi C Lau
(74) *Attorney, Agent, or Firm*—Alfred M. Walker

(57) ABSTRACT

A traffic light safety zone is a painted marked area, of parallel lines, approaching a traffic intersection to warn motorists whether they can safety proceed through the road intersection before a traffic sign light turns red, the zones are configured to indicate whether a motorist in the zone has clearance at a designated speed to proceed and cross with safety, the zone parallel colored thermal plastic painted lines form a visual indicator, and give an audio output due to the thickness of the thermal painted plastic; a distinctive traffic sign indicates to motorists of an approaching traffic light safety zone.

7 Claims, 7 Drawing Sheets

6
Legend
Yellow strip 2
Red strip 3
Traffic direction
L4
L3

L1
L2
2
3

6
Legend
Yellow strip 2
Red strip 3
Traffic direction
L4
L3

L1
L2
3
2

TRAFFIC LIGHT SAFETY ZONE

FIELD OF THE INVENTION

The present invention relates to highway traffic safety.

BACKGROUND

Every day motorists run red traffic lights. This is a potentially dangerous situation and often causes accidents. A contributing factor is motorists are unsure, as they approach the traffic light, at that distance from the traffic lights is there sufficient time to cross safety should the traffic light change. Traffic light safety zones are designed to provide guidance as to whether the motorist can safely cross the traffic light before the light changes to red.

As the traffic lights change from Green to Amber (yellow) to Red, the change occurs suddenly. Even though the change from Green to Amber provides a warning that the motorist should prepare to stop, the light change does not provide guidance nor indicate to motorist at what distance from the light is there sufficient time to proceed and cross the intersection in safety or that there is not sufficient time to proceed and cross the intersection with safety; they have to slow down, stop and not cross the intersection.

Other patents associated with road traffic light safety are mainly technical, utilize technology and incorporate electronics devices.

For example US Patent Publication no. 20040201497 of Naljutov describes a system where the green traffic light changes to a blinking green light to indicate that the light is going to change to amber (yellow). U.S. Pat. No. 6,388,578 BI of Fagan describes a speed limit indicator at the entrance to a speed zone, utilizing an electronic sender incorporated in the roadway and receiver in the vehicle. In addition U.S. Pat. No. 5,457,439 of Kuhn is concerned with speed safety and involves display screen technology, signals and a computer.

OBJECTS OF THE INVENTION

The objective of the traffic light safety zones is to prevent accidents and promote safety at traffic lights controlled intersections.

SUMMARY OF THE INVENTION

In contrast, to the aforesaid prior art patent, the Traffic Light Safety Zone is a non-technical, simple, easily understood system, which lets motorists know whether they can or cannot cross the traffic light before the light turns red.

It is low cost, easy to maintain, requires no special knowledge to install and is very effective. The road color markings and the roadside sign can be visual interpreted.

In addition it has the potential to become an international road safety device because it is visual; the color, markings, audio and roadside sign can be easily understood and universally recognized.

The Traffic Light Safety Zone is a simply visual and audio system that provides safety guidance to motorists as they approach intersection controlled traffic lights. The traffic light is Green as the motorist approaches. The light changes to Amber (yellow). The system discloses to motorists how best to proceed, whether to continue and cross or whether to brake and stop. Both have the potential to cause accidents. The Traffic Safety Zone of the present invention provides information and guidance how to proceed.

This is done by indicating to motorists that:

1) there is sufficient time to cross the intersection, as the light turns from Green to Amber and before the light turns Red, or,
2) there is not sufficient time to cross the intersection, as the light turns from Green to Amber and before the light turns Red.

The zones are located at specific distances before the light. This distance is determined by the road speed limit. See FIGS. 1, 2, 3 and 4. The distance and road speed limit are correlated to determine the location that allows the motorist to know whether or not they will make the light and cross the intersection with safety.

This is how the Traffic Safety Zone of the present invention operates:

a) Motorists entering the zone when the light is Green will cross the intersection with safety, even if the light turns Amber and before the light turns Red. They maintain speed and cross the intersection with safety.
b) Motorists entering the Traffic Safety Zone when the light has turned Amber will not have sufficient time to cross the intersection before the light turns Red. Motorists should slow down and prepare to stop.

DESCRIPTION OF DRAWINGS

The present invention can best be understood in conjunction with the accompanying drawings, in which.

REFERENCE NUMERALS

Figure 1:
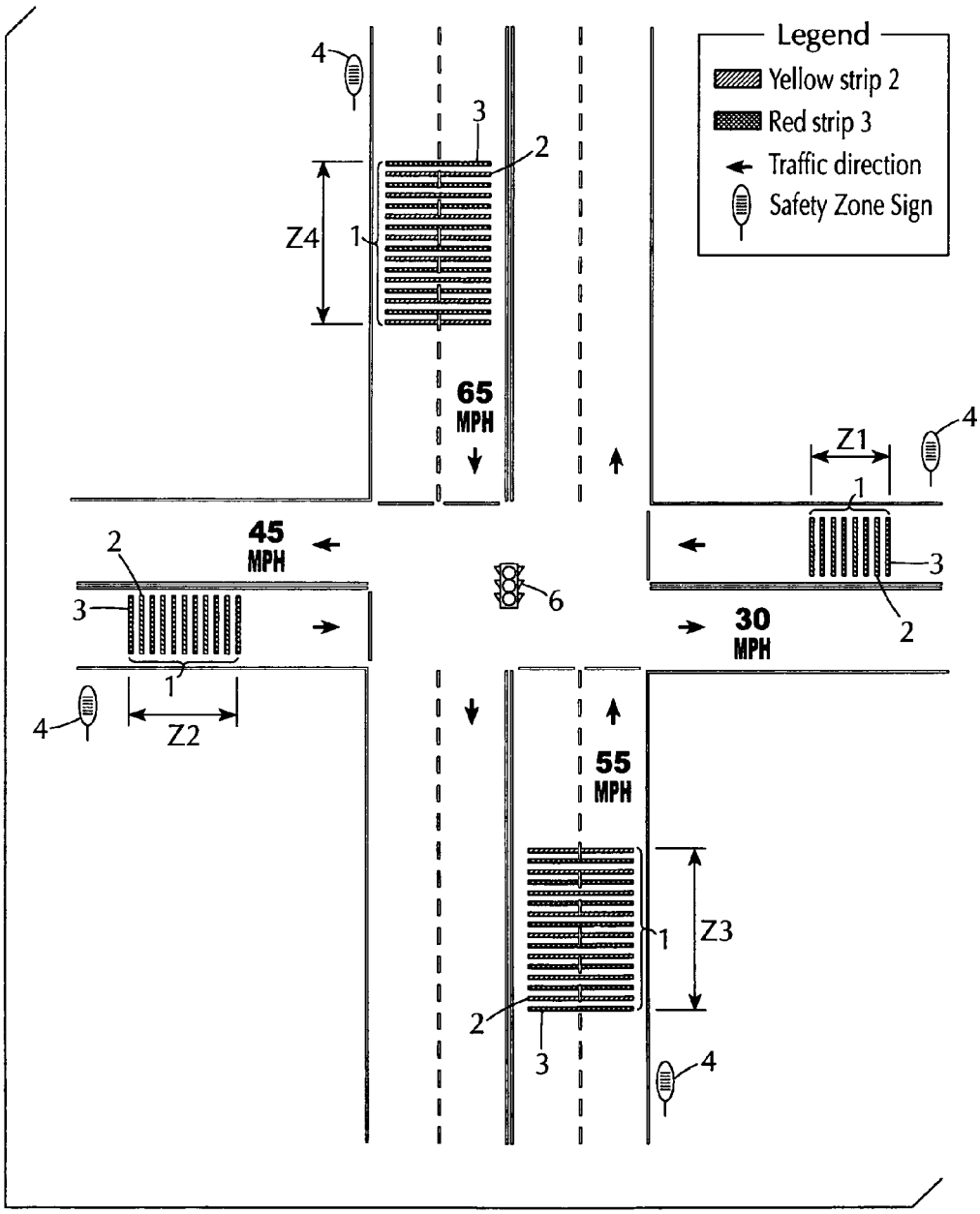
FIG. 1 is a diagrammatic top plan overview of a traffic light safety zone at an intersection of multiformity of roads of different speed limits, for illustration purposes only. The overview shows the position of each zone relative to the intersection, wherein the arrows indicate direction of vehicular travel.

The following are drawing reference numerals shown in the drawings:

Reference numeral 1 is the traffic safety zone;

Reference numeral 2 is the yellow line in the zone;

Reference numeral 3 is the red line in the zone;

Reference numeral 4 is the visible sign, indicating to the motorist that he or she is approaching a traffic safety zone 1;

Reference numeral 5 is the sign words.

Reference numeral 6 is the traffic light;

Reference numeral Z1 represents the length of a traffic safety zone for 30 miles per hour vehicle speed;

Reference numeral Z2 represents the length of a traffic safety zone for 45 miles per hour vehicle speed;

Reference numeral Z3 represents the length of a traffic safety zone for 55 miles per hour vehicle speed;

Reference numeral Z4 represents the length of a traffic safety zone for 65 miles per hour vehicle speed;

Reference numeral L1 represents the distance between adjacent red and amber (yellow) lines in each zone;

Reference numeral L2 represents the length of a zone;

Reference numeral L3 represents the distance from the entry of a zone until entering an intersection; and, Reference numeral L4 represents the distance from the first entry of a zone until passing though and ultimately clearing an intersection.

Reference character mph represents miles per hour.

Description of Traffic Light Safety Zones

As shown in FIGS. 1, 2, 3, 4 and 5, the traffic safety zones (1) are a visually perceptible array of parallel painted indicia lines, stripes or bars, (2) and (3) which extend across the traffic lane. The zones (1) are preferable painted alternative yellow (amber), indicia (2) and red indicia (3) or vice versa. Yellow (amber) signals caution and red signals danger making motorists more aware of the situation they are approaching.

Although the width of painted lines (2) and (3) may vary, typically the lines are preferable four inches by nine feet wide marked thermal plastic painted lines (such as stripes or bars) across the traffic lane. While line thickness may vary, line thickness is approximately 0.100 inches. The painted lines are typically on forty-eight inch centers.

The paint has a reflective quality, which is what enhances the road marking appearance during night driving when the vehicle lights shine on the painted markings (2) and (3).

Figure 2:
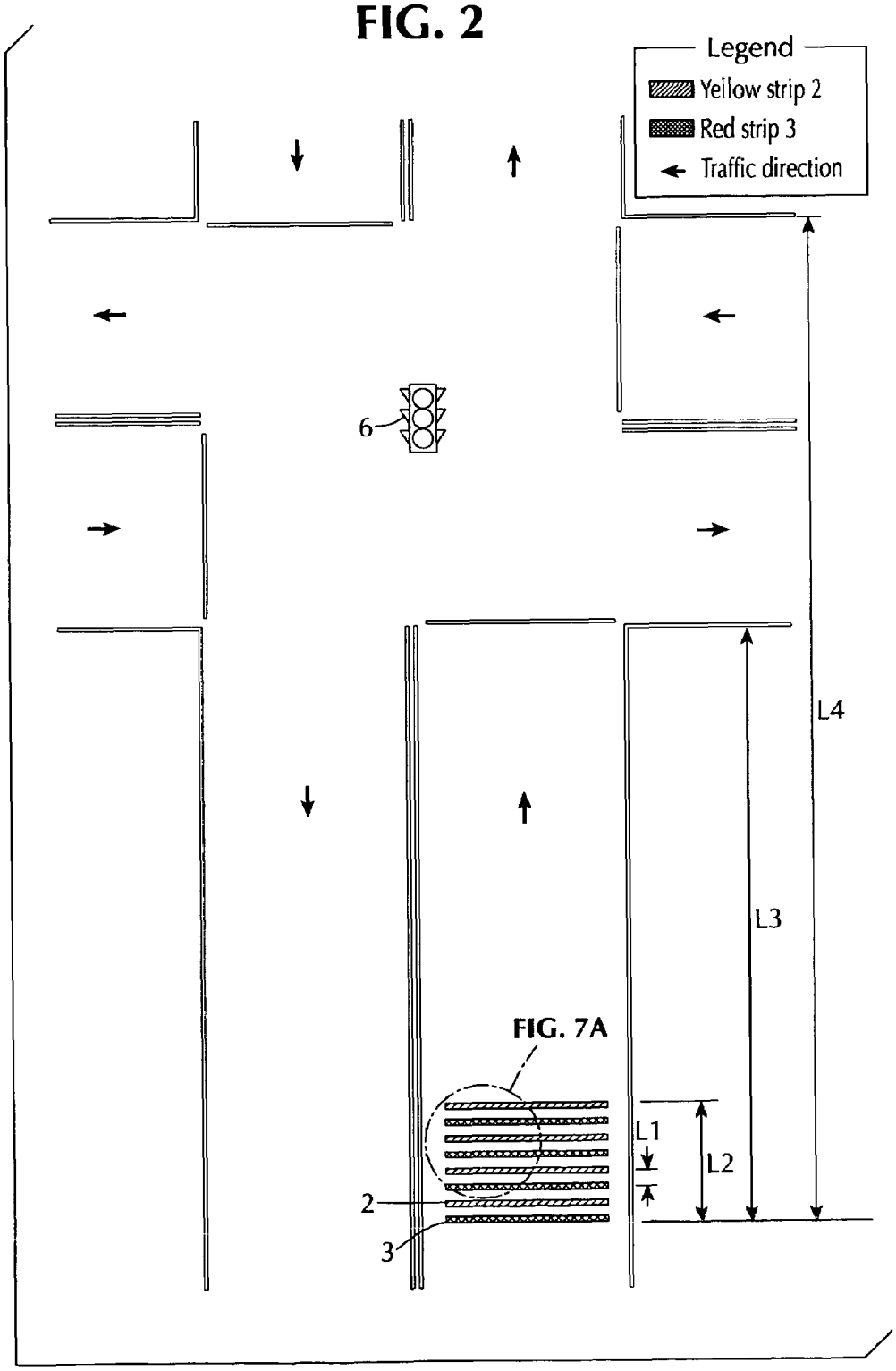
FIG. 2 is a diagrammatic top plan view of a traffic light safety zone approach at a two road intersection, wherein the road speed limit is 30 mph, showing the position of the zone relative to the intersection, wherein each road has a single lane in each opposite direction. For illustration the drawing only shows one zone, but all approaches typically have zones, wherein the arrows indicate direction of vehicular travel.
Figures 3, 7A:
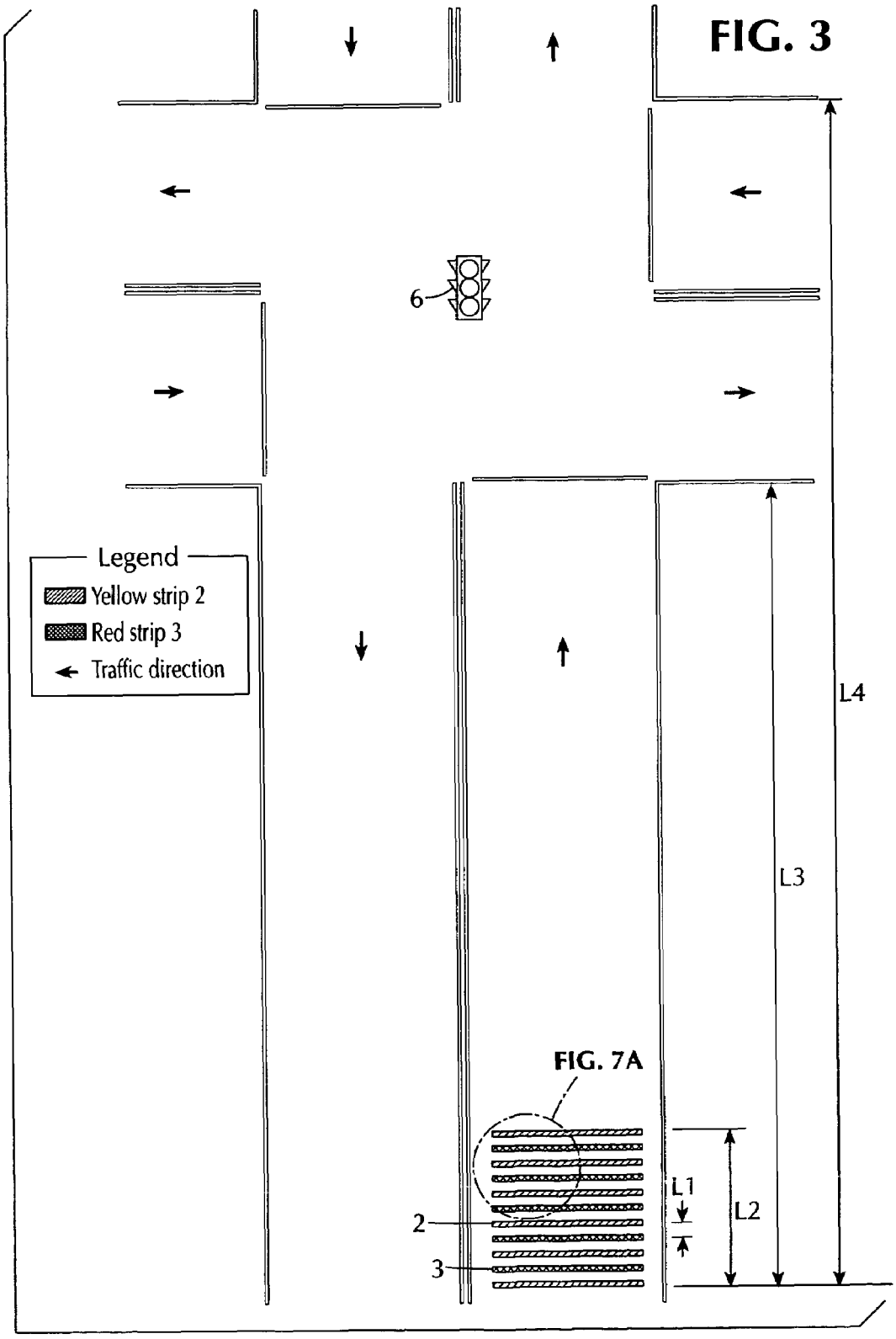
FIG. 3 is a diagrammatic top plan view of a traffic light safety zone approach at a two road intersection, wherein the road speed limit is 45 mph, showing is the position of the zone relative to the intersection, wherein each road has a single lane in each opposite direction. For illustration the drawing only shows one zone, but all approaches typically have zones, wherein the arrows indicate direction of vehicular travel.
FIG. 7A is a close-up top plan view of a portion of the traffic safety zone as in FIG. 2, taken within the dashed line circle shown in FIG. 2.
Figure 4:
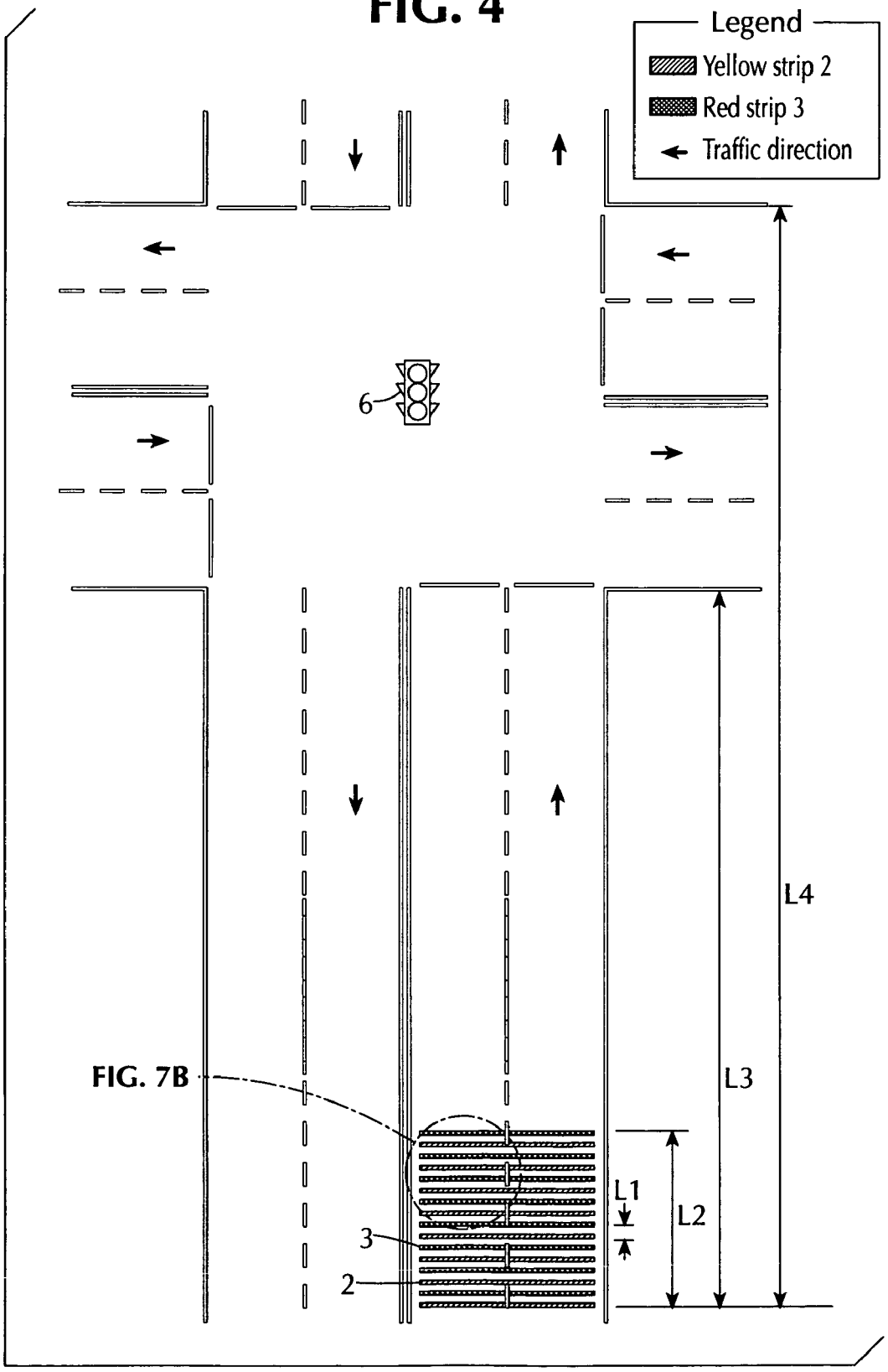
FIG. 4 is a diagrammatic top plan view of a traffic light safety zone approach at a two road intersection, wherein the road speed limit is 55 mph, showing is the position of the zone relative to the intersection, wherein each road has a pair of lanes in each direction. For illustration the drawing only shows one zone, but all approaches typically have zones, wherein the arrows indicate direction of vehicular travel.
Figures 5, 7B:
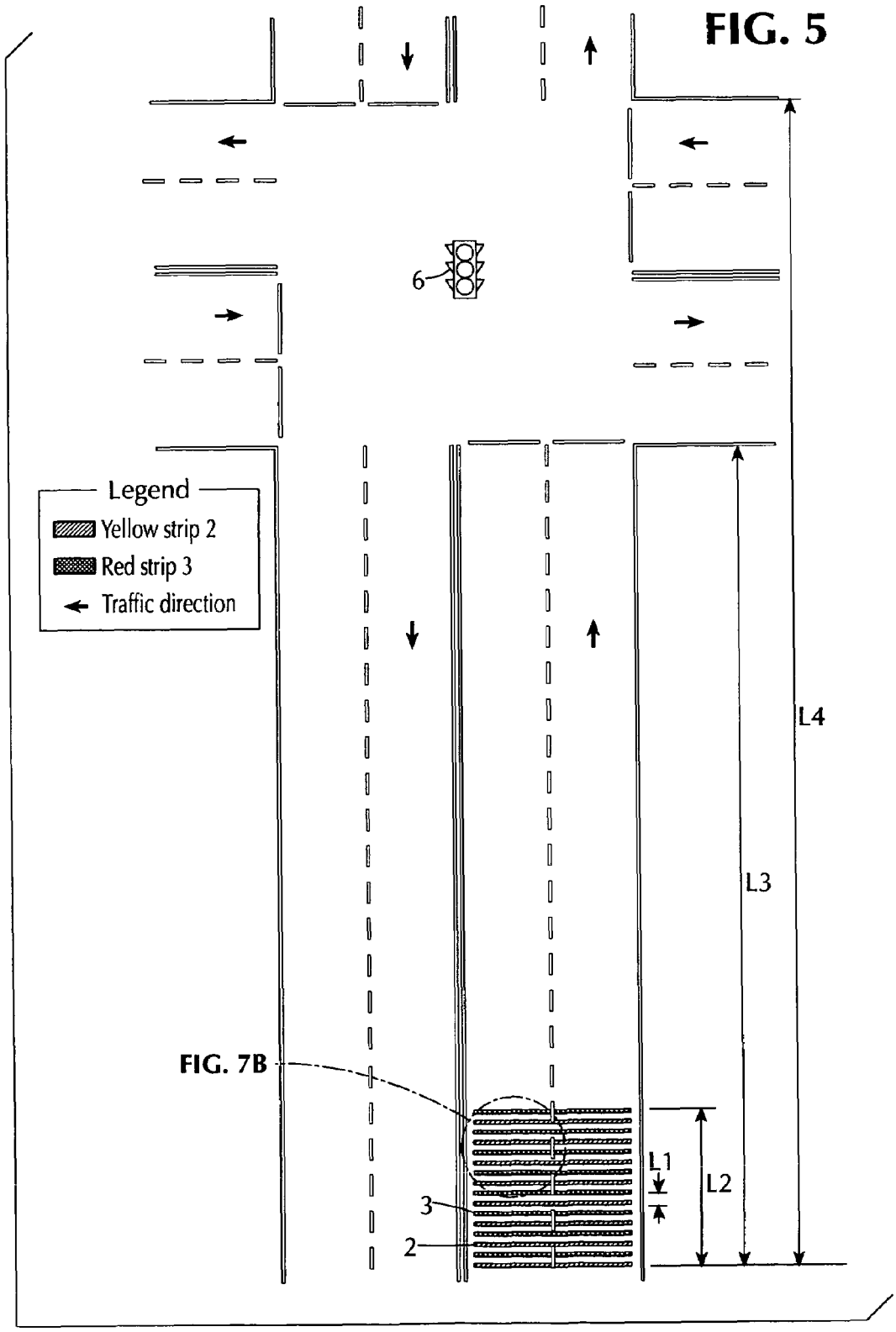
FIG. 5 is a diagrammatic top plan view of a traffic light safety zone approach at a two road intersection, wherein the road speed limit is 65 mph, showing the position of the zone relative to the intersection, wherein the arrows indicate direction of vehicular travel. For illustration the drawing only shows one zone, but all approaches typically have zones.
FIG. 7B is a close-up top plan view of the traffic safety zone as in FIG. 3, taken within the dashed line circle shown in FIG. 3.

The lengths of the zones is:

For 30 mph (miles per hour) road speed limit the length Z1 of the zone is 32 feet, as in FIG. 2;

For 45 mph road speed limit the length Z2 of the zone is 44 feet, as in FIG. 3;

For 55 mph road speed limit the length Z3 of the zone is 64 feet, as in FIG. 4; and, For 65 mph road speed limit the length Z4 of the zone is 64 feet, as in FIG. 5.

Audible Sound:

As shown in FIGS. 2, 3, 4 and 5, L1 represents the distance between stripes or lines (2) and (3), typically four feet.

In addition to the zone visible lines, these parallel marked thermal plastic painted lines, (2) and (3), provide a distinguish sound when driving over them, making the motorist aware that they are in the respective traffic light safety zone (1).

Since the lines (2) and (3) have a thickness of 0.100", this tangible painted depth gives a distinguished sound as the motorist drives through the zone, (1), without impeding the motorist's driving.

The important significance is that the painted lines (2) and (3) clearly indicate to the motorist they are in a traffic light safety zone (1) as they approach the traffic light (6) at a roadway intersection.

Figure 6:
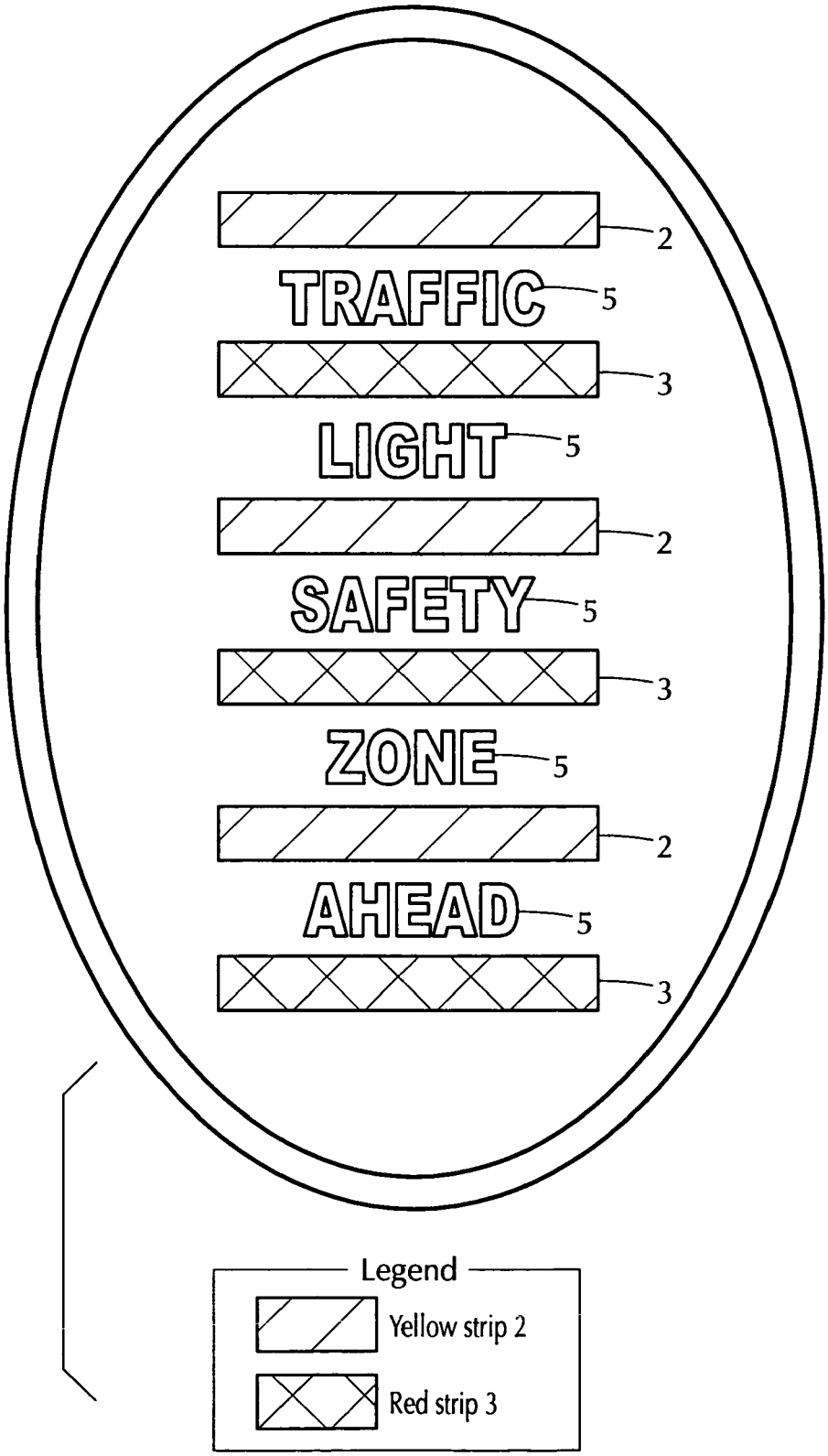
FIG. 6 is a front elevation view of a typical roadside traffic light safety zone sign indicating an approaching traffic light safety zone to a motorist approaching an intersection.
Figure 7A:
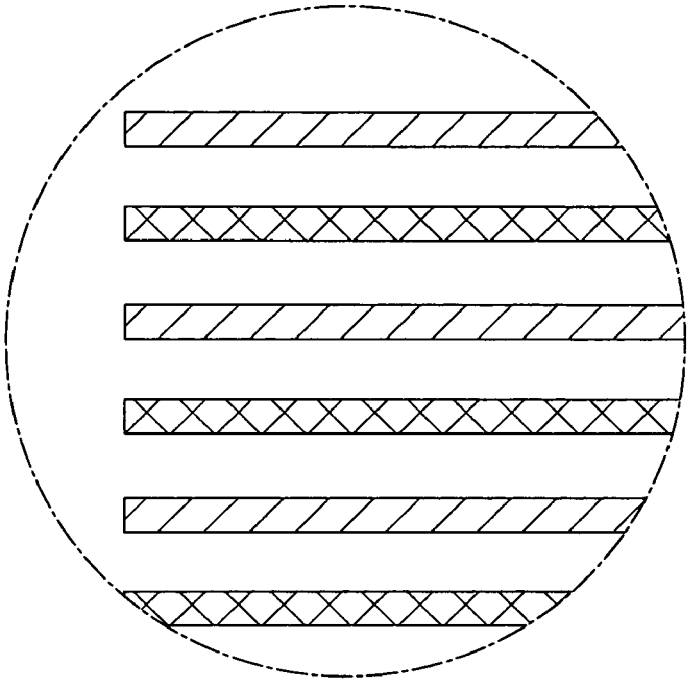
Figure 7B:
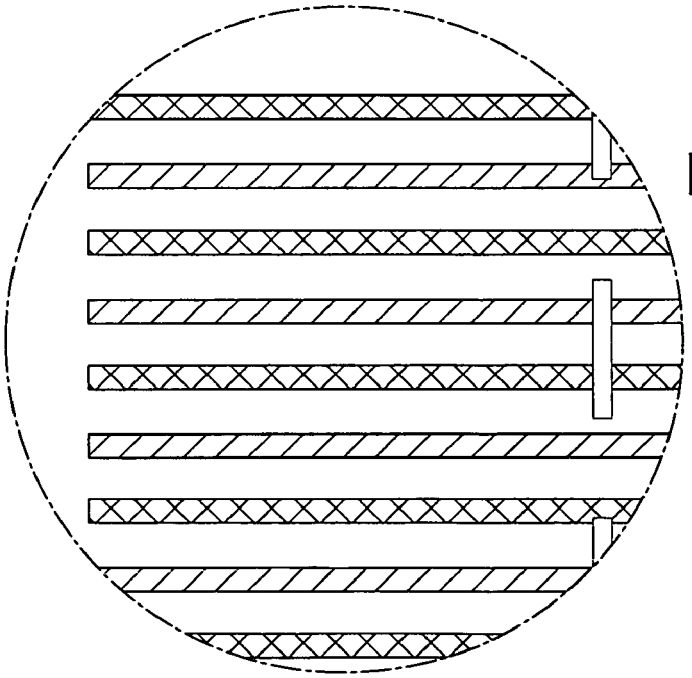

Road Sign:

In conjunction with the traffic safety zones (1), there is a zone roadside sign, (4); as in FIG. 6, alerting and indicating to motorists, that there is a traffic light safety zone (1) ahead. The sign (4) preferably reads "TRAFFIC LIGHT SAFETY ZONE AHEAD" in the appropriate street sign language of the municipality involved.

The roadside traffic light safety zone sign (4) is a distinctive, preferable, oval shape. The sign (4) is preferably mounted lengthways. The sign (4) has corresponding horizontal yellow and red painted bars (2) and (3), preferably on a white background, with the indicia words "Traffic Light Safety Zone Ahead" (5), printed between each line (2) and (3). The yellow and red painted bars (2) and (3) correspond to the bars or stripes (2) and (3) on the roadway in the actual painted zone (1).

FIG. 7A shows a close-up view of a portion of traffic safety zone (1) for a roadway with a single lane in each direction.

FIG. 7B shows a close-up view of a portion of a traffic safety zone (1) for a roadway with a pair of lanes in each direction, where lane demarcation lines perpendicular to the red and yellow lines (2) and (3) are also shown extending parallel to the axis of vehicular travel in the lanes of the roadway.

DETAIL DESCRIPTION OF THE EMBODIMENTS

Each traffic safety zone (1) is specific to that particular traffic light (6). The road speed limit determines the length and location of each zone (1), relative to the traffic light (6). (See FIGS. 2, 3, 4 and 5.)

In determining the specifics, the time the light is yellow or amber and the time it takes the motorist to travel from entering the zone (1), to exiting the intersection are important factors.

The length L2 of each zone Z1, Z2, Z3 and Z4 depends upon the speed limit as noted before. The length L3 is the distance from entry of zone (1) to entry of the intersection, typically 150 feet for 30 mph, 230 feet for 45 mph, 260 feet for 55 mph and 320 feet for 65 mph. The length L4 is the distance from the entry of zone (1) until clearance out of a intersection, typically 176 feet for 30 mph, 264 feet for 45 mph, 320feet for 55 mph and 380 feet for 65 mph.

The system is based on the time the amber light is on. The amber light is on for typically five seconds.

The system has built in safety time allowances.

As the green light changes to amber the system typically allows 0.5 second.

As the amber light changes to red the system typically allows 0.5 second.

A built in safety reduces the time factor by about one second, making the operating time to cross the intersection four seconds. This is the basis for the location of the zone (1) specific to the individual traffic lights (6).

All calculations of length and location of zones (1) are based on this safety factor, wherein the distance traveled in typically four seconds and the vehicle stopping distance for that speed limit.

The zones (1) remove the uncertainty as to whether to speed up and cross or to slow down and stop.

The essential element of the traffic light safety zones (1) is the correlation of timing, distance, speed and location. The zones (1) take into consideration time, speed and the position where the motorist is when the light changes from green to amber.

For "TIME", the amber light is on for typically five seconds.

For "SPEED", the road speed limit determines the location of the zone (1).

For "DISTANCE", the distance is the actual distance within which the motorist has to travel, from entering the zone (1), to exiting the intersection.

The built in safety factor is based on the amber light being on for five seconds.

One second is deducted for the awareness of the light changing. The four remaining seconds are the operating time and relative to the road speed limit which determines the location of the zone (1), thus ensuring that the motorist is across the intersection before the light turns red.

Benefits

The traffic safety zone (1) promotes increased safety at traffic lights (6), by giving motorists the means to gauge how to proceed safely approaching traffic light controlled intersections, as the light changes from green to amber.

The benefits of the traffic light safety zones (1) are:

a) Increased safety at traffic lights intersections;

b) Reducing the amount of motorists running the red light;

c) Reducing the potential for accidents;

d) Increasing traffic flow at intersections;

e) Indicating that there is a traffic light (6) ahead; and, f) Removal of the uncertainty as to whether to speed up and cross or to slow down and stop.

The most efficient and ideal situation for traffic light safety zones (1) is:

a) On a road when the traffic light (6) can be seen in the distance;

b) On a road roads where traffic lights (6) are unexpected;

c) On a road where there is considerable distance between traffic lights (6); and, d) During late night driving when most main or primary road traffic lights (6) are mainly green but may change to amber and red suddenly.

The zones (1) are applicable in all situations where the light (6) can be seen before the motorist enters the zone (1).

The zone (1) is most important during inclement weather, particularly during poor visibility weather, foggy, misty or low visible conditions, when traffic lights (6) may not be seen but the road markings can be seen through the vehicle headlights.

The zone road marking and audible sound produced by vehicular traffic thereon will alert motorists that they are approaching traffic lights (6), thus providing motorists additional safety guidance at traffic light crossings.

In addition there is preferably an accompanying roadside sign (4) (see FIG. 6) that will indicate to motorists they are approaching traffic light safety zone (1).

The system is of imminent value at camera compliance traffic lights (6). This removes the excuses from motorists who run the red light. They do so knowing that they are committing a traffic infraction.

Calculations:

Location Chart

Each location of a traffic safety zone (1) is specific to the road speed limit and specific distances from the traffic light intersection.

For example:

at 30 mph speed limit the location of zone (1) starts at a distance L4 of 176 feet from the intersection clearance exit;

at 45 mph speed limit the location of zone (1) starts at a distance L4 of 264 feet from the intersection clearance exit;

at 55 mph speed limit the location of zone (1) starts at a distance L4 of 320 feet from the intersection exit; and, at 65 mph speed limit the location of zone (1) starts at a distance L4 of 380 feet from the intersection exit.

The amber light is typically on for five seconds. If so, the system uses a typical time duration of four seconds. Therefore the system has built in time safety margins of one second. Calculations are averaged and rounded up.

At 30 mph vehicle travels 44 feet per second. In four seconds the vehicle typically travels 176 ft.

At 30 mph, location of the beginning of zone (1) is at a distance L3 of 150 feet before entry into an intersection containing a traffic light, see FIG. 2

(The stopping distance for cars is 105 feet and trucks are 140 ft.)

At 45 mph vehicle travels 66 feet per second. In four seconds the vehicle typically travels 264 ft.

At 45 mph, the location of the beginning of zone (1) is at a distance L3 of 230 feet before entry into an intersection containing a traffic light, see FIG. 3.

(The stopping distance for cars therefore is 160 feet and trucks are 210 ft.)

At 55 mph vehicle travels 80 feet per second. In four seconds the vehicle typically travels 320 ft.

At 55 mph, location of the beginning of zone (1) is at a distance L3 of 260 feet before entry into an intersection containing a traffic light, see FIG. 4.

(The stopping distance for cars is therefore 200 feet and trucks are 260 ft.)

At 65 mph vehicle travels 95 feet. per second. In four seconds the vehicle typically travels 380 ft.

At 65 mph, location of the beginning of zone (1) is at a distance L3 of 320 feet before entry into an intersection containing a traffic light, see FIG. 5.

(The stopping distance for cars is 230 feet and trucks are 310 ft.)

(reference: New York State Department of Motor Vehicles)

It is further noted that the length of a zone (1) depends upon the units of speed locally used. For example, in Canada and Europe, the length would be expressed in meters and the speed in kilometers per hour, as would all dimensions and speeds be expressed in the methods of measurements used in that country or state.

The municipal authority installing traffic light safety zones (1) can select the colors(s), style, type, width, length and the distance between lines (2) and (3) etc. that suit their need.

The traffic light safety zone (1) system is an affordable, low cost, non-technical system, which is cheap to install, requires no special skill to implement and is easy to maintain.

This present invention includes all similar types, styles, and marking. The length, widths distance, locations and all alternatives that is similar to this invention.

It is further noted that the aforesaid description is illustrative and that other embodiment may be disclosed in accordance with the subject of the invention and as applicable to State, federal and international traffic regulations.

The invention includes relative aspects not necessary included herein but are in keeping with the spirit, scope and integrity of this invention.

I claim:

1. A traffic light safety zone indicating to approaching motorists whether a motorist can safely proceed through a roadway traffic light controlled intersection, said zone comprising a visually marked zone located on and affixed to the roadway at a prescribed distance from said intersection, said zone being configured to indicate to the motorist, that while approaching the intersection at a prescribed speed for said roadway, the motorist in said zone has sufficient time to proceed through said intersection, said prescribed distance being measured from a leading edge of said zone as said motorist approaches said intersection to a clearance exit of said intersection, said zone having a length along said roadway which is a function of said prescribed speed.

2. The traffic light safety zone as in claim 1, wherein said visual marked zone is a painted zone of a predetermine size, imparting a visual indicia to a motorist.

3. The traffic light safety zone in claim 1, wherein said visual marked zone includes a painted thermal plastic stripe of specific thickness, imparting an audio signal through vehicles tires to the motorist.

4. The traffic light safety zone in claim 1, wherein said visual marked zone is a plurality of parallel stripes of alternating colors.

5. The traffic light safety zone in claim 1, further comprising a sign having visual indicia indicating to a driver that said traffic light safety zone is forthcoming.

6. The traffic light safety zone in claim 1, wherein the prescribed distance through an intersection and road speed limit are correlated to indicate the location of the said traffic light safety zone in advance of said intersection.

7. A method of providing information and guidance to a vehicle driver how to proceed with safety as the driver approaches an intersection with traffic lights, comprising the steps of:

a) providing bright red and yellow spaced parallel lines painted across a road to alert drivers that they are in a traffic light safety zone indicating that it is safe for the drivers to proceed through the intersection, said traffic light safety zone having a length along said road which is a function of a prescribed speed for said road, b) providing an audio signal indicating that the drivers are in said road traffic light safety zone, c) providing a road-sign to indicate to said drivers that they are approaching a traffic light safety zone, and d) locating a leading edge of said traffic light safety zone as said zone is approached a prescribed distance from a clearance exit of said intersection depending on the prescribed speed for said road so that if the traffic light turns yellow when in said safety zone drivers will know that their vehicles will clear the intersection before the traffic light turns red.

* * * * *